US006786243B2

(12) United States Patent
Moriarty et al.

(10) Patent No.: US 6,786,243 B2
(45) Date of Patent: Sep. 7, 2004

(54) MONOFILAMENT STRUCTURE TO MONITOR FABRIC ABRASION

(75) Inventors: Michael G. Moriarty, Bellston Lake, NY (US); William A. Luciano, Saratoga Springs, NY (US)

(73) Assignee: Albany International Corp., Albany, NY (US)

( * ) Notice: Subject to any disclaimer, the term of this patent is extended or adjusted under 35 U.S.C. 154(b) by 85 days.

(21) Appl. No.: 10/167,100

(22) Filed: Jun. 11, 2002

(65) Prior Publication Data

US 2003/0226611 A1 Dec. 11, 2003

(51) Int. Cl.[7] ..... D03D 15/00
(52) U.S. Cl. ..... 139/420 R; 442/200
(58) Field of Search ..... 139/383 R, 384 R, 139/386, 387 R, 420 R, 425 R, 426 R, 420 A, 393 A, 383 A; 442/199–202

(56) References Cited

U.S. PATENT DOCUMENTS 4,283,455 A * 8/1981 McGee ..... 442/72
4,533,594 A 8/1985 Buchanan
5,617,903 A 4/1997 Bowen, Jr.
5,685,014 A * 11/1997 Dapsalmon ..... 2/16
5,888,915 A 3/1999 Denton et al.

* cited by examiner

*Primary Examiner*—Danny Worrell
(74) *Attorney, Agent, or Firm*—Frommer Lawrence & Haug LLP; Ronald R. Santucci

(57) ABSTRACT

An industrial fabric of the variety used in the papermaking and similar industries has machine-direction (MD) yarns and cross-machine-direction (CD) yarns, which may be interwoven with one another to form a woven structure. The industrial fabric includes, as at least some of the MD and/or CD yarns, sheath/core yarns which have a core yarn surrounded by a sheath. The core yarn and the sheath are visually distinguishable by the naked eye from one another, such as by color, so that wear on a surface of the industrial fabric can be monitored visually during its operating life by the visual change that would become apparent when the sheath is worn away from the core yarn.

23 Claims, 2 Drawing Sheets

MONOFILAMENT STRUCTURE TO MONITOR FABRIC ABRASION

BACKGROUND OF THE INVENTION

1. Field of the Invention

The present invention relates to the papermaking and related arts. More specifically, the present invention relates to papermaker's fabrics, namely the forming, press and dryer fabrics, also known collectively as paper machine clothing, on which paper is manufactured on a paper machine. In addition, the present invention may find application in other industrial settings, where industrial belts are used to dewater a material, such as in pulp washing and thickening and in sludge dewatering.

2. Description of the Prior Art

During the papermaking process, a cellulosic fibrous web is formed by depositing a fibrous slurry, that is, an aqueous dispersion of cellulose fibers, on a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which cause the cellulosic fibers in the web to adhere to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speed. That is to say, the fibrous slurry is continuously deposited onto the forming fabric in the forming section, while a newly manufactured paper sheet is continuously wound onto rolls after it exits from the dryer section.

Operating, as they do, in the form of endless loops on paper machines, papermaker's fabrics, and particularly their inner surfaces, are susceptible to abrasive wear. Much of this wear results from contact with stationery components of the paper machine. Ultimately, many fabrics must be removed from paper machines when the wear caused by such moving contact has reduced the thickness of the fabric, at least in some locations, to the point where it is weakened or has lost some quality or characteristic desired by papermakers in its particular application.

Normally, wear is monitored using a thickness gauge. However, it is difficult to measure the thickness of a papermaker's fabric more than a foot or two in from its edges with such a gauge, especially when the fabric is running on a paper machine.

Clearly, a means for monitoring wear on a papermaker's fabric, and particularly at any point on its inner and outer surfaces, even when the paper machine is operating, would be very helpful to those in the papermaking industry. The present invention provides such a means to the industry.

SUMMARY OF THE INVENTION

Accordingly, the present invention is an industrial fabric of the variety used in papermaking and related industries, and in other industries where a fabric is used in dewatering some material. The industrial fabric comprises machine-direction (MD) yarns and cross-machine direction (CD) yarns, which may be interwoven with one another to give the industrial fabric a woven structure.

At least some, and possibly all, of either the MD yarns or the CD yarns, or of both the MD and CD yarns, are sheath/core yarns. The sheath/core yarns comprise a core yarn surrounded by a sheath, wherein the core yarn and the sheath are visually distinguishable by the naked eye from one another, such as by color. This enables wear on a surface of the industrial fabric to be monitored visually during the operating life thereof, as abrasion gradually wears away the sheath on exposed portions of the sheath/core yarns, particularly surface knuckles, revealing the core yarns, perhaps by their differing color.

The present invention will now be described in more complete detail with frequent reference being made to the drawings identified below.

DETAILED DESCRIPTION OF THE PREFERRED EMBODIMENTS

Figure 1:
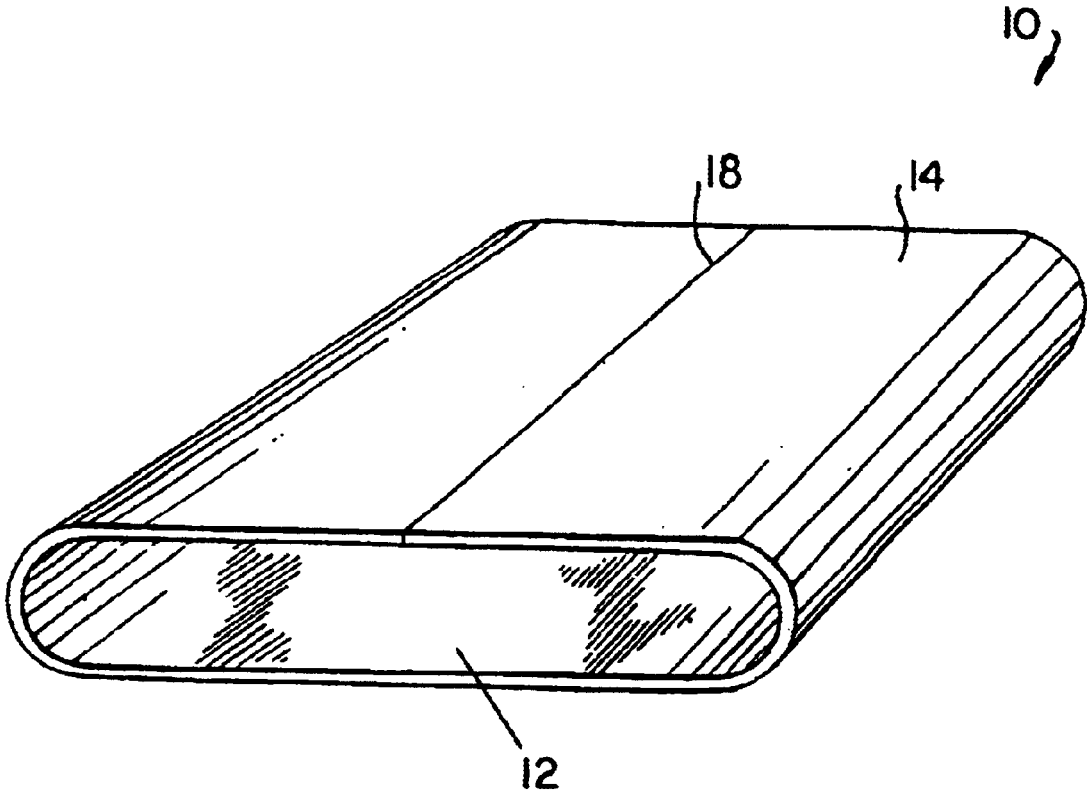
FIG. 1 is a perspective view of an industrial fabric.

Turning now to these figures, FIG. 1 is a perspective view of an industrial fabric 10 which may be improved in accordance with the present invention. The industrial fabric 10 is shown to be in the form of an endless loop, the form in which it is used in its particular application, and has an inner surface 12 and an outer surface 14. It may be produced or woven in endless form, or produced in a form which enables it to be joined into endless form with a seam 18 during installation on the machine for which it is intended. As such, the industrial fabric 10 may be produced by modified endless weaving, which yields a fabric having a plurality of seaming loops along its two widthwise edges for joining the fabric 10 into endless form.

Typically, industrial fabric 10 is a structure woven from warp yarns and weft yarns, although it need not be woven to fall within the scope of the present invention, and could be a nonwoven structure. As is well known to those of ordinary skill in the art, the warp yarns lie in the cross-machine direction (CD) of the fabric 10 produced by either endless or modified endless weaving, while they lie in the machine direction (MD) if the fabric 10 is flat woven. On the other hand, the weft yarns lie in the machine direction (MD) of a fabric 10 produced by endless or modified endless weaving, but in the cross-machine direction (CD) of a flat woven fabric.

Figure 2:
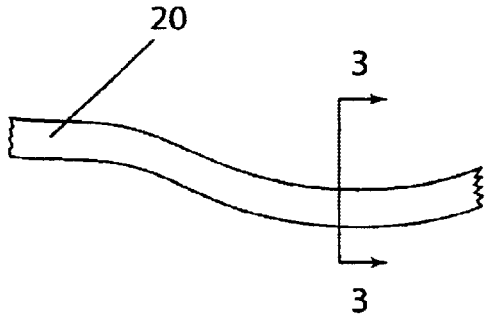
FIG. 2 is a side view of a sheath/core yarn.
Figure 3:
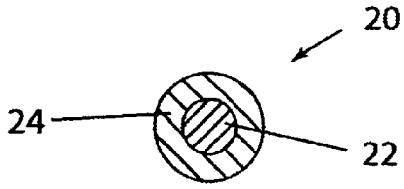
FIG. 3 is a cross-sectional view taken as indicated by line 3—3 in FIG. 2.

Referring now to the yarns in terms of their orientations on the machine on which fabric 10 is intended to be used, at least some of the MD yarns and/or at least some of the CD yarns are sheath/core yarns of the variety shown in FIGS. 2 and 3.

FIG. 2 is a side view of a sheath/core yarn 20, and FIG. 3 is a cross-sectional view thereof As shown most clearly in FIG. 3, sheath/core yarn 20 includes a core yarn 22.

Although drawn in FIG. 3 as a monofilament, core yarn 22 may be a monofilament, a plied/twisted monofilament, a multifilament, a plied multifilament, a braided or a knitted yarn. Where the core yarn 22 is a monofilament, it may be of circular or non-circular cross section, the latter including oval, elliptical, square, rectangular and lobed cross sections. The core yarn 22 may be extruded, or otherwise produced, from any of the polymeric resin materials commonly used by those of ordinary skill in the art for producing yarns for use in industrial fabrics, such as, for example, polyamide, polyester, polyetherketone, polypropylene, polyaramid, polyolefin and polyethylene terephthalate (PET) resins. The filaments so obtained are incorporated into core yarns 22 according to techniques well known in the textile industry and particularly in the industrial fabric industry.

The core yarn 22 is surrounded or covered by a sheath 24. The sheath 24 may be a coating of any of the above-mentioned polymeric resin materials. Where the core yarn 22 is a monofilament, the coating may be applied by crosshead extrusion to form sheath 24. The sheath 24 may also be produced by wrapping a film or fibers of one of the above-mentioned polymeric resin materials about the core yarn 22. The core yarn 22 and the sheath 24 may be of the same or of different polymeric resin materials.

The sheath/core yarn 20 enables the papermaker to monitor fabric wear because, in accordance with the present invention, the sheath 24 and core yarn 22 are visually distinguishable by the naked eye from one another. Preferably, the sheath 24 and core yarn 22 are of two different and contrasting colors, so that wear may be plainly evident when the surface of the industrial fabric 10 has been abraded to the point where the sheath 24 has been worn to expose the core yarn 22 therewithin. For example, the core yarn 22 may be of a bright color, while the sheath 24 may include a white pigment, such as titanium dioxide, which would hide the color of the core yarn 22 from view until the sheath 24 was sufficiently worn away to expose it. Alternatively, the core yarn 22 may be of a material that changes color upon exposure to heat and/or moisture, so that, once the surface of the industrial fabric 10 has been abraded sufficiently to expose the core yarn 22, it will change color to visually indicate the wear. The pH-indicating dyes known to those of ordinary skill in the art, such as phenolphthalein or litmus, may be used for this purpose. Alternatively still, the core yarn 22 may include a UV-sensitive dye which, when the sheath 24 is sufficiently worn away, would be made readily visible by exposure to an ultraviolet-light source.

Figure 4:
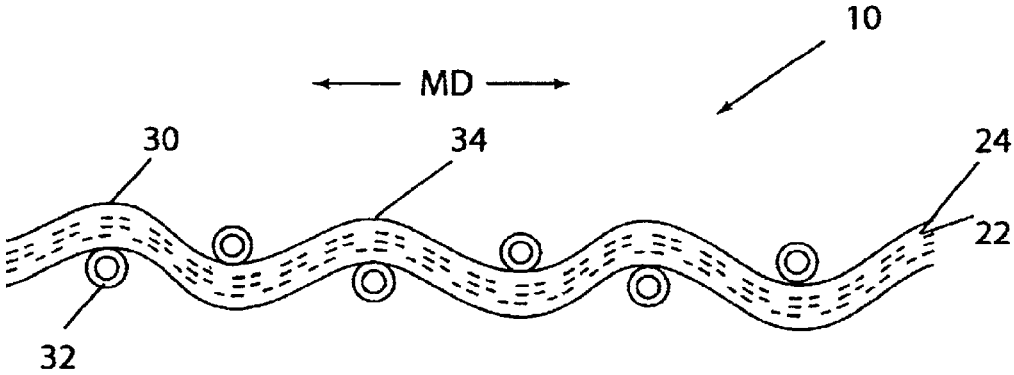
FIG. 4 is a cross-sectional view taken in the machine direction of an unused industrial fabric.

Typically, the knuckles on the surface of the industrial fabric 10 are most susceptible to wear because they are formed where a yarn in one direction of the fabric passes or crosses over one in the other direction, and are therefore elevated points on the surface of the fabric. For example, FIG. 4 is a cross-sectional view of an unused industrial fabric 10 taken in the machine direction. MD yarn 30, which is a sheath/core yarn 20, is depicted as weaving with CD yarns 32, also sheath/core yarns 20, in a plain weave. Knuckles 34 are the points most exposed to wear.

Figure 5:
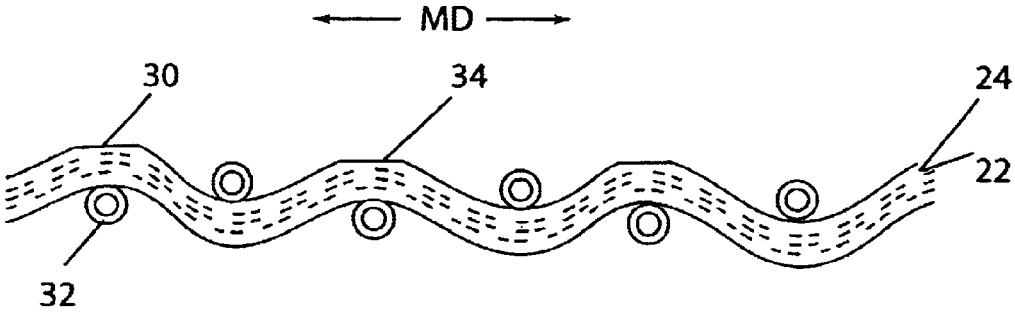
FIG. 5 is a cross-sectional view, analogous to that provided in FIG. 4, of a worn industrial fabric.

After the fabric 10 has been used for some period of time, the same cross-sectional view of the industrial fabric 10 will appear as shown in FIG. 5. The sheath 24 of MD yarn 30 is shown to be worn away to the point where core yarn 22 is exposed to view. By virtue of its different color, for example, compared to that of sheath 24, the core yarn 22 gives an indication of the wear of the fabric 10.

The present invention enables the person skilled in the art to monitor the condition of an industrial fabric 10 even when it is running on the machine for which it is intended. It further enables the skilled person to monitor wear across the full width of the fabric, and to detect wear streaks, which are specific regions in which wear is more serious or proceeding more rapidly than in others.

The present invention is amenable to use in paper machine clothing, namely, forming, press and dryer fabrics used by papermakers, as well as in other belts used in the papermaking industry, such as through-air-drying (TAD) belts, long nip press belts, calender belts and transfer belts. The present invention, however, is also amenable to use in many other industries where woven fabric belts are used, such as in pulp washing, sludge dewatering, and in the manufacture of nonwoven fabrics. It may also be used in the double-nip-thickener (DNT) belts used in the pulp industry.

Modifications to the above would be obvious to those of ordinary skill in the art, but would not bring the invention so modified beyond the scope of the appended claims.

What is claimed is:

1. An industrial fabric for use in papermaking and related industries, and in other industries where a fabric is used in dewatering some material, said industrial fabric comprising machine direction (MD) and cross-machine-direction (CD) yarns wherein at least some of one of said MD yarns and said CD yarns are sheath/core yarns, said sheath/core yarns having a core yarn surrounded by a sheath, said core yarn and said sheath being distinguishable from one another, so that wear on a surface of said industrial fabric can be monitored during said fabric's operating life.

2. An industrial fabric as claimed in claim 1 wherein at least some of both of said MD yarns and said CD yarn are sheath/core yarns.

3. An industrial fabric as claimed in claim 2 wherein all of one of said MD yarns and said CD yearns are sheath/core yarns.

4. An industrial fabric as claimed in claim 1 wherein all of both of said MD yarns and said CD yarns are sheath/core yarns.

5. An industrial fabric as claimed in claim 1 wherein said core yarn is selected from the group consisting of monofilament, plied/twisted monofilament, multifilament, plied multifilament, braided and knitted yarns.

6. An industrial fabric as claimed in claim 1 wherein said core yarn is of a polymeric resin material.

7. An industrial fabric as claimed in claim 6 wherein said polymeric resin material is selected from the group consisting of polyamide, polyester, polyetherketone, polypropylene, polyaramid, polyolefin and polyethylene terephthalate (PET) resins.

8. An industrial fabric as claimed in claim 1 wherein said core yarn is a monofilament yarn of circular cross section.

9. An industrial fabric as claimed in claim 1 wherein said core yarn is a monofilament yarn of a non-circular cross section.

10. An industrial fabric as claimed in claim 9 wherein said non-circular cross section is selected from the group consisting of oval, elliptical, square, rectangular and lobed cross sections.

11. An industrial fabric as claimed in claim 1 wherein said sheath is of a polymeric resin material.

12. An industrial fabric as claimed in claim 11 wherein said polymeric resin material is selected from the group consisting of polyamide, polyester, polyetherketone, polypropylene, polyaramid, polyolefin and polyethylene terephthalate (PET) resins.

13. An industrial fabric as claimed in claim 1 wherein said sheath is a coating on said core yarn.

14. An industrial fabric as claimed in claim 1 wherein said sheath is a film of a polymeric resin material wrapped around said core yarn.

15. An industrial fabric as claimed in claim 1 wherein said sheath is of fibers of a polymeric resin material wrapped around said core yarn.

16. An industrial fabric as claimed in claim 1 wherein said core yarn and said sheath are of the same polymeric resin material.

17. An industrial fabric as claimed in claim 1 wherein said core yarn and said sheath are different polymeric resin materials.

18. An industrial fabric as claimed in claim 1 wherein said core yarn and said sheath are of different colors.

19. An industrial fabric as claimed in claim 1 wherein said core yarn is of a color different from the color of said sheath upon exposure to heat or moisture.

20. An industrial fabric as claimed in claim 1 wherein said MD yarns are interwoven with said CD yarns t form said industrial fabric.

21. An industrial fabric as claimed in claim 19 wherein said core yarn includes a pH-indicating dye.

22. An industrial fabric as claimed in claim 1 wherein said core yarn includes a UV-sensitive dye.

23. An industrial fabric as claimed in claim 1 wherein said sheath includes titanium dioxide pigment.

* * * * *